US009661735B2

(12) United States Patent
Yamamoto et al.

(10) Patent No.: US 9,661,735 B2
(45) Date of Patent: May 23, 2017

(54) SYNCHROTRON INJECTOR SYSTEM, AND SYNCHROTRON SYSTEM OPERATION METHOD

(71) Applicant: MITSUBISHI ELECTRIC CORPORATION, Chiyoda-ku, Tokyo (JP)

(72) Inventors: Kazuo Yamamoto, Tokyo (JP); Sadahiro Kawasaki, Tokyo (JP); Hiromitsu Inoue, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/024,737

(22) PCT Filed: Nov. 26, 2013

(86) PCT No.: PCT/JP2013/081750
§ 371 (c)(1),
(2) Date: Mar. 24, 2016

(87) PCT Pub. No.: WO2015/079487
PCT Pub. Date: Jun. 4, 2015

(65) Prior Publication Data

US 2016/0249444 A1 Aug. 25, 2016

(51) Int. Cl.
*H05H 7/08* (2006.01)
*H05H 9/00* (2006.01)
*H05H 13/04* (2006.01)

(52) U.S. Cl.
CPC ..... *H05H 7/08* (2013.01); *H05H 9/00* (2013.01); *H05H 13/04* (2013.01); *H05H 2007/082* (2013.01); *H05H 2277/10* (2013.01)

(58) Field of Classification Search
USPC ..... 250/396 R, 397, 396 ML, 423 R, 424
See application file for complete search history.

(56) References Cited

U.S. PATENT DOCUMENTS

| | | | |
|---|---|---|---|
| 6,683,318 | B1 | 1/2004 | Haberer et al. |
| 2009/0195194 | A1 | 8/2009 | Takayama et al. |
| 2013/0038248 | A1 | 2/2013 | Yamamoto et al. |

FOREIGN PATENT DOCUMENTS

| | | | |
|---|---|---|---|
| JP | 44-12796 | A | 5/1969 |
| JP | 05-13196 | A | 1/1993 |

(Continued)

OTHER PUBLICATIONS

International Search Report (PCT/ISA/210) issued on Feb. 4, 2014, by the Japanese Patent Office as the International Searching Authority for International Application No. PCT/JP2013/081750.

*Primary Examiner* — Nicole Ippolito
*Assistant Examiner* — Hanway Chang
(74) *Attorney, Agent, or Firm* — Buchanan Ingersoll & Rooney PC

(57) ABSTRACT

A synchrotron injector system comprising a first ion source which generates a first ion, a second ion source which generates a second ion having a smaller charge-to-mass ratio than a charge-to-mass ratio of the first ion, a pre-accelerator having the capability to enable to accelerate both the first ion and the second ion, a low-energy beam transport line which is constituted in such a way to inject either the first ion or the second ion into the pre-accelerator, and a self-focusing type post-accelerator which accelerates only the first ion after acceleration which is emitted from the pre-accelerator.

8 Claims, 4 Drawing Sheets

(56) References Cited

FOREIGN PATENT DOCUMENTS

| | | | |
|---|---|---|---|
| JP | 08-339900 | A | 12/1996 |
| JP | 2006-310013 | A1 | 11/2006 |
| JP | 2009-217938 | A | 9/2009 |
| WO | WO 00/16342 | A1 | 3/2000 |
| WO | WO 2012/008255 | A1 | 1/2012 |

SYNCHROTRON INJECTOR SYSTEM, AND SYNCHROTRON SYSTEM OPERATION METHOD

TECHNICAL FIELD

This invention relates to a synchrotron injector system for injecting different kinds of ions into a synchrotron so as to enable to accelerate different kinds of ions in one synchrotron accelerator system.

BACKGROUND ART

Charged particles are accelerated by a synchrotron and a particle beam, a bundle of high-energy charged particles which are emitted from the synchrotron, is used to treat cancer, for example. Regarding a particle beam for medical treatment, in some cases, it is preferable to select a kind of a particle beam depending on an object to be treated. Consequently, it is expected to configure one synchrotron accelerator system to enable to emit different kinds of particle beams. Synchrotrons accelerate charged particles that is, ions, which are injected, and in order to enable to emit different kinds of particle beams, a synchrotron injector system which injects different kinds of ions into a synchrotron is necessary.

Patent Document 1 discloses technology by which all kinds of ions can be accelerated to desired level of energy in the same synchrotron. Regarding an injector system for injecting ions into the synchrotron, it is stated such that an ion beam which is accelerated to a given level of energy by a pre-accelerator is injected.

Further, in Patent Document 2, it is stated such that in order to use a proton beam together with a carbon beam, ion sources which generate each of beams are necessary, however, the details regarding a pre-accelerator which injects ions into a synchrotron are not stated.

Further, Patent Document 3 discloses the configuration in which a particle beam such as protons of large current can be accelerated in an APF-IH linear accelerator.

PRIOR ART REFERENCE

Patent Document

[Patent Document 1]
Japanese Patent Application Laid-Open No. 2006-310013 (Paragraph 0058, etc.)
[Patent Document 2]
Japanese Patent Application Laid-Open No. 2009-217938 (Paragraph 0048, etc.)
[Patent Document 3]
International publication WO2012/008255

DISCLOSURE OF THE INVENTION

Problems to be Solved by the Invention

In a synchrotron injector system which preliminarily accelerates different kinds of ions, for example, a proton and a carbon ion so as to enable to accelerate in a synchrotron, as described in Patent Document 1, different kinds of ions are accelerated to the same level of energy. As above mentioned, conventionally synchrotron injector systems are tied down to the conditions which are the same preliminary acceleration energy for both kinds and the same accelerator, etc. The above mentioned conventional injector systems are injector systems whose preliminary acceleration energy is not optimum for each of kinds of ions, therefore, the injector systems are inefficient and large-sized. An ion whose charge-to-mass ratio (charge/mass) is large (for example, a proton:charge/mass=1/1) has large space charge effect, therefore it is preferable for incident energy to a synchrotron to be larger, in comparison with an ion whose charge-to-mass ratio is small (for example, a carbon ion:charge/mass=4/12). An ion whose charge-to-mass ratio is small needs higher acceleration voltage to be accelerated in comparison with an ion whose charge-to-mass ratio is large, therefore the size of an accelerator is larger. Consequently, it is preferable for incident energy to a synchrotron to be lower in comparison with an ion whose charge-to-mass ratio is large. Conventionally, the above-mentioned problems cannot be solved, regardless of an ion whose charge-to-mass is large or an ion whose charge-to-mass is small, incident energy to a synchrotron is fixed to the same, and size of a synchrotron is large.

This invention is made to solve the above-mentioned problems of conventional synchrotron injector systems, and an objective of this invention is to obtain a small-sized synchrotron injector system by which different kinds of ions can be accelerated to different levels of energy so as to be emitted.

Means for Solving the Problems

A synchrotron injector system of this invention is a synchrotron injector system which emits an ion which is injected into a synchrotron and comprises a first ion source which generates a first ion, a second ion source which generates a second ion having a smaller charge-to-mass ratio than a charge-to-mass ratio of the first ion, a pre-accelerator having the capability to enable to accelerate both the first ion and the second ion, a low-energy beam transport line which is constituted in such a way to inject either the first ion or the second ion into the pre-accelerator, and a self-focusing type post-accelerator which accelerates only the first ion after acceleration which is emitted from the pre-accelerator.

Advantage of the Invention

According to this invention, a small-sized synchrotron injector system which can emit different kinds of ion with different energy can be provided.

EMBODIMENTS FOR CARRYING OUT THE INVENTION

Regarding synchrotron injector systems, accelerating a heavy ion needs greater electric power than accelerating a light ion. Consequently, first, an accelerator which accelerates ions to the energy which is needed by a carbon ion, that is, a heavy ion is designed. Regarding a light proton, based on ideas such that in an accelerator which accelerates an ion to the energy which is needed by a carbon ion, by reducing electric power, a proton can be accelerated to the same energy as that of a carbon ion, conventionally, injector systems, in which a carbon ion and a proton are accelerated to the same energy so as to be emitted, are realized. However, in a case of an ion whose charge-to-mass ratio is large such as a proton, it is preferable for incident energy to a synchrotron to be larger in comparison with a case of an ion whose charge-to-mass ratio is small such as a carbon. Conventionally, designing accelerators for a heavy carbon ion is first priority, therefore, there is no ideas such that an injector system in which a carbon ion and a proton are emitted with different energy is realized by the same injector system.

On the other hand, according to this invention, the idea such that an injector system which is optimized for an ion whose charge-to-mass ratio is small is used to accelerate an ion whose charge-to-mass ratio is large is abandoned, based on an idea which is opposite to conventional ideas, that is, a part of an injector system which accelerates an ion whose charge-to-mass ratio is large to incident energy which is suitable for a synchrotron is used for accelerating an ion whose charge-to-mass ratio is small, an injector system to accelerate different ions to different energy can be realized. According to the above-mentioned idea, regarding an ion whose charge-to-mass ratio is small and an ion whose charge-to-mass ratio is large, an injector system whose size is small, by which suitable energy for each of the above-mentioned ions can be emitted as incident energy to a synchrotron, can be realized. Hereinafter, the details of this invention will be described referring to EMBODIMENTs.

Embodiment 1

Figure 1:
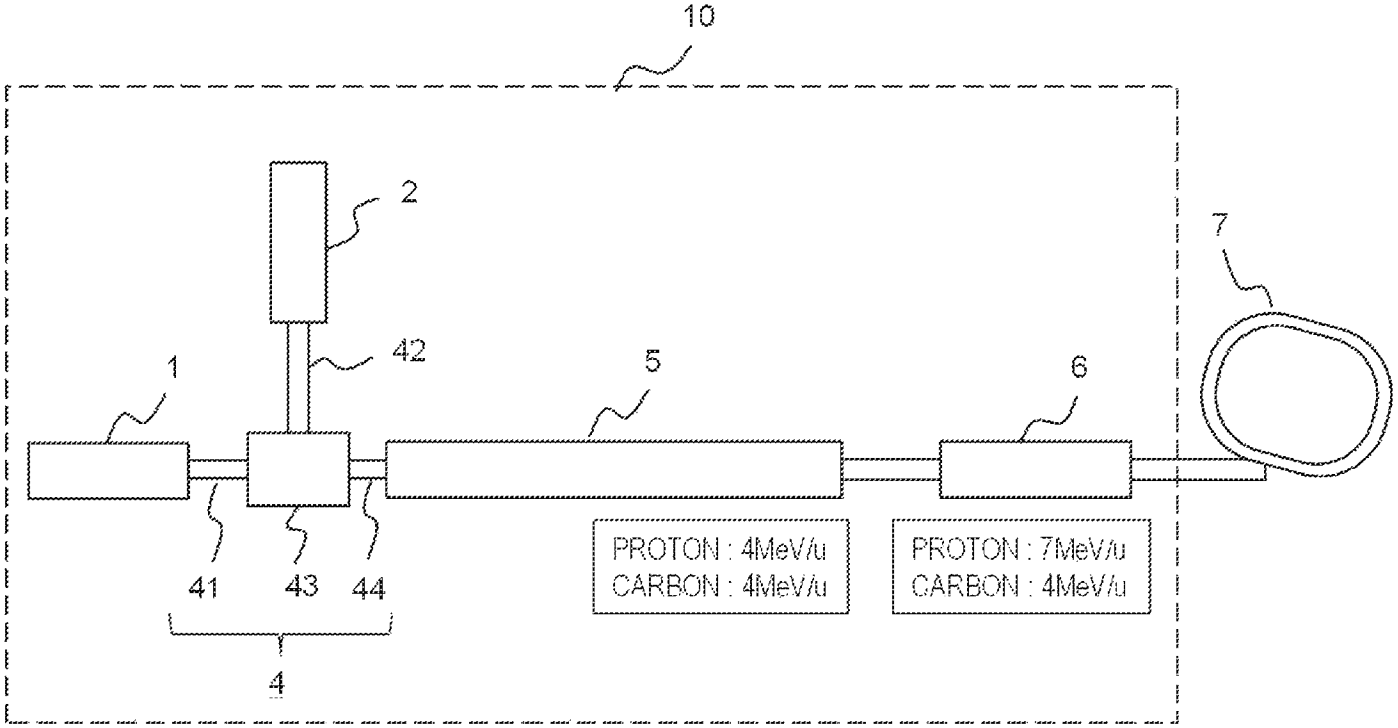
FIG. 1 is a block diagram showing the configuration of a synchrotron injector system according to EMBODIMENT 1 of this invention.

FIG. 1 is a block diagram showing a configuration of a synchrotron injector system according to EMBODIMENT 1 of this invention. A synchrotron injector system 10 enables to inject two kinds of ions into a synchrotron 7. The synchrotron injector system 10 comprises a first ion source 1 which generates a first ion and a second ion source 2 which generates a second ion having a smaller charge-to-mass ratio than that of the first ion. Hereinafter, referring to a case in which a proton is used as a first ion and a carbon ion is used as a second ion, the details will be described. However, any combination of a first ion and a second ion whose charge-to-mass ratio is smaller than that of the first ion can be applied to this invention. For example, a combination of a proton as a first ion (charge-to-mass ratio=1) and a helium ion as a second ion (charge-to-mass ratio=1/2) or a combination of a helium ion as a first ion and a carbon ion as a second ion can be applied to this invention.

A proton is monovalent, and when mass of a proton is 1, a charge-to-mass ratio of a proton is 1/1. A carbon ion is tetravalent, and when mass of a proton is 1, mass of a carbon ion is 12, therefore a charge-to-mass ratio of a carbon ion is 4/12. As above mentioned, a charge-to-mass ratio of a carbon ion is smaller than that of a proton. A proton which is generated by the first ion source 1 passes through a first low-energy beam transport line 41, a carbon ion which is generated by the second ion source 2 passes through a second low-energy beam transport line 42 and is injected into a joining device 43. It is configured such that the first low-energy beam transport line 41 and the second low-energy beam transport line 42 are joined by the joining device 43 and merge with one beam line 44 so as for a proton or a carbon ion to be injected into a pre-accelerator 5. A transport line where a proton is emitted from the first ion source 1 and is injected into the pre-accelerator 5 and a transport line where a carbon ion is emitted from the second ion source 2 and is injected into the pre-accelerator 5 are collectively called a low-energy beam transport line 4.

In the joining device 43, a carbon ion form the second ion source 2 is deflected so as to merge with the beam line 44. Carbon ions which are emitted from the second ion source 2 contains carbon ions having different valence except for tetravalent. In an accelerator, only carbon ions which are tetravalent are accelerated. Consequently, it is configured such that by deflecting carbon ions from the second ion source 2 at a part of the joining device 43, only carbon ions which are tetravalent are made to merge with the beam line 44.

The pre-accelerator 5 is configured to accelerate protons or carbon ions which are injected to 4 MeV/u, for example. That is, the pre-accelerator 5 has an ability to accelerate both protons and carbon ions. Protons or carbon ions which are emitted from the pre-accelerator 5 are injected into a post-accelerator 6. The post-accelerator 6 is a self-focusing type accelerator which does not contain an electromagnet for converging ions such as APF (Alternating-Phase Focusing)-IH (Interdigital-H) kind linear accelerator, etc. The post-accelerator 6 is configured to accelerate protons, for example, from 4 MeV/u to 7 MeV/u. In a case where ions which are injected into the post-accelerator 6 are protons, for example, protons are accelerated to 7 MeV/u and are emitted. However, in a case where ions which are injected are carbon ions, an acceleration operation is not performed by the post-accelerator 6, and the carbon ions are emitted with energy of 4 MeV/u as they are. Further, it is configured to inject protons with 7 MeV/u or carbon ions with 4 MeV/u which are emitted into the synchrotron 7 so as to be accelerated.

As above mentioned, for example, in a case where an ion which is needed as a particle beam for medical treatment is a proton, in a synchrotron injector system according to EMBODIMENT 1 of this invention, protons are generated by the first ion source 1 and are injected into the pre-accelerator 5 via the low energy beam transport line 4 and are accelerated to energy of 4 MeV/u. The protons which are accelerated to energy of 4 MeV/u are accelerated by the post-accelerator 6 to energy of 7 MeV/u and are injected into the synchrotron 7. In the synchrotron 7, the protons are further accelerated to energy which is needed for medical treatment.

On the other hand, in a case where an ion which is needed as a particle beam for medical treatment is a carbon ion, carbon ions are generated by the second ion source 2 and are injected into the pre-accelerator 5 via the low energy beam transport line 4 and are accelerated to energy of 4 MeV/u. The carbon ions which are accelerated to energy of 4 MeV/u are injected into the post-accelerator 6, however, in the post-accelerator 6, the carbon ions are not accelerated and are emitted with energy of 4 Mev/u as they are and are injected into the synchrotron 7. In the synchrotron 7, the carbo ions are further accelerated to energy which is needed for medical treatment.

As above mentioned, in a case where ions which are injected into the post-accelerator 6 are carbon ions, an acceleration operation is not performed by the post-accelerator 6, and the carbon ions which are injected are passed through the post-accelerator 6 and are emitted. The post-accelerator 6 is a self-focusing type accelerator which does not contain an electromagnet, therefore the carbon ions which are injected are not influenced by a magnetic field and can be emitted as they are. Further, the post-accelerator 6 is configured so as to enable to accelerate only protons. Consequently, in comparison with an accelerator having the configuration in which carbon ions also can be accelerated, the post-accelerator 6 having the above-mentioned configuration requires less energy and whose size can be miniaturized.

Here, it is preferable such that a beam diameter of the post-accelerator 6 is made to be larger than that of the pre-accelerator 5. When a beam diameter of the post-accelerator 6, for example, an aperture diameter of an acceleration electrode is made to be larger than a beam diameter of the pre-accelerator 5, contamination which is caused by the situation, that is, carbon ions passing through in the post-accelerator 6 hit an electrode, etc. so as to be lost, can be prevented.

As above mentioned, in a synchrotron injector system according to EMBODIMENT 1, the pre-accelerator 5 is configured so as to enable to accelerate both a carbon ion whose charge-to-mass ratio is small and a proton whose charge-to-mass ratio is large to energy which is suitable for a carbon ion whose charge-to-mass ratio is small as incident energy of a synchrotron, and the post-accelerator 6 is configured so as to accelerate a proton whose charge-to-mass ratio is large to energy which is suitable as incident energy of a synchrotron. Consequently, as an injector which can inject two kinds of ions into a synchrotron, a small-sized synchrotron injector system by which both of a carbon ion whose charge-to-mass ratio is small and a proton whose charge-to-mass ratio is large can be accelerated to energy which is suitable as incident energy to a synchrotron and is emitted can be realized.

Embodiment 2

Figure 2:
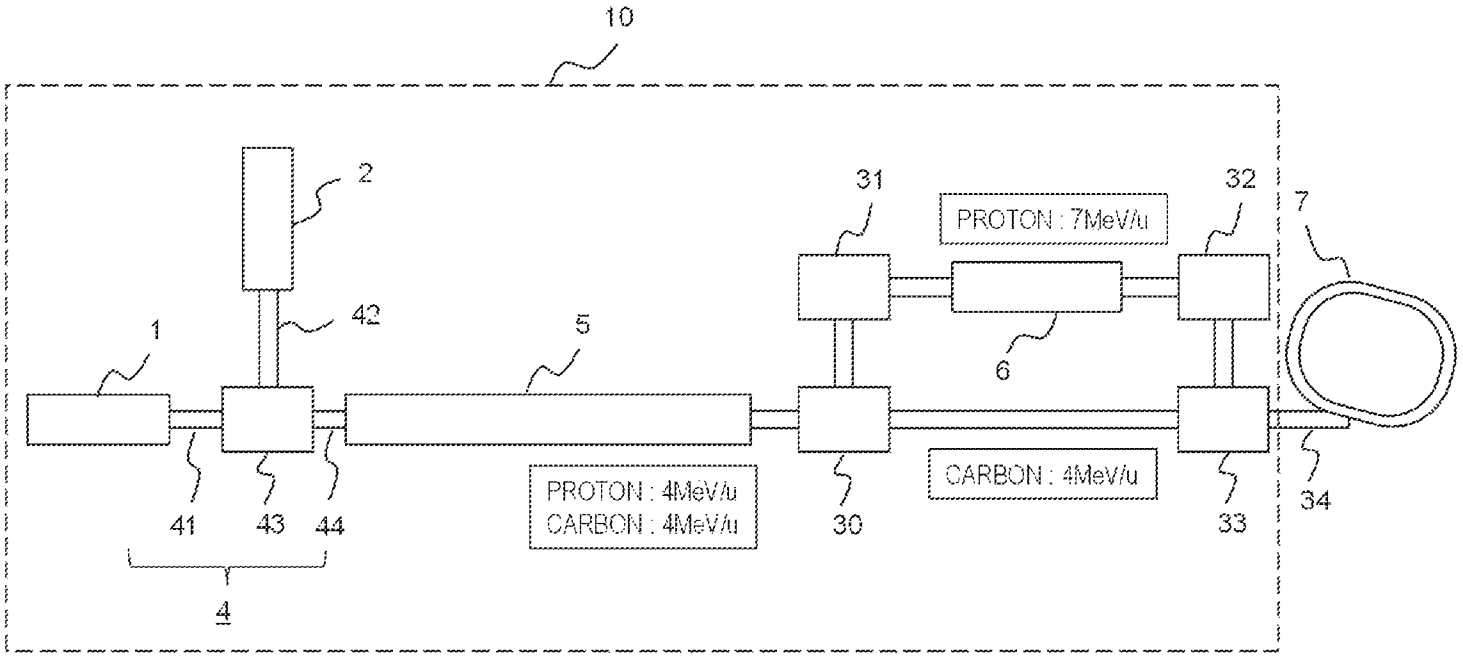
FIG. 2 is a block diagram showing the configuration of a synchrotron injector system according to EMBODIMENT 2 of this invention.

FIG. 2 is a block diagram showing the configuration of a synchrotron injector system according to EMBODIMENT 2 of this invention. In the same way as that of EMBODIMENT 1, a first ion source 1 which generates a first ion and a second ion source 2 which generates a second ion having a smaller charge-to-mass ratio than that of the first ion source are provided. A proton which is generated by the first ion source 1 passes through a first low-energy beam transport line 41, a carbon ion which is generated by the second ion source 2 passes through a second low-energy beam transport line 42 and are injected into a joining device 43. It is configured such that the first low-energy beam transport line 41 and the second low-energy beam transport line 42 are joined by the joining device 43 and merge with one beam line 44 so as for a proton or a carbon ion to be injected into a pre-accelerator 5.

The pre-accelerator 5 is configured to accelerate protons or carbon ions which are injected to 4 MeV/u, for example. Protons or carbon ions which are emitted from the pre-accelerator 5 are injected into a distributor 30. In a case where ions are protons, the protons are transported from the distributor 30 via a deflector so as to be injected into a post-accelerator 6. The post-accelerator 6 is a self-focusing type accelerator which does not contain an electromagnet for converging ions such as APF (Alternating-Phase Focusing)-IH (Interdigital-H) kind linear accelerator, etc. The post-accelerator 6 is configured to accelerate protons, for example, from 4 MeV/u to 7 MeV/u.

On the other hand, in a case where ions are carbon ions, it is configured such that the carbon ions which are emitted from the pre-accelerator 5 pass through the distributor 30 and a joining device 33 and do not pass through the post-accelerator 6, and the carbon ions are emitted from a medium energy beam transport line 34 so as to be injected directly into a synchrotron 7.

It is configured such that the protons which are accelerated by the post-accelerator 6 to 7 MeV/u, for example, merge with the medium energy beam transport line 34, where carbon ions also pass through, via a deflector 32 and the joining device 33 and are injected to a synchrotron.

As above mentioned, regarding a synchrotron injector system according to EMBODIMENT 2, for example in a case where an ion which is needed as a particle beam for medical treatment is a proton, protons are generated by the first ion source 1 and are injected into the pre-accelerator 5 via a low-energy beam transport line 4 so as to be accelerated to energy of 4 MeV/u. Protons which are accelerated to energy of 4 MeV/u are accelerated by the post-accelerator 6 to energy of 7 MeV/u so as to be injected into the synchrotron 7. In the synchrotron 7, the protons are further accelerated to energy which is needed for medical treatment.

On the other hand, in a case where an ion which is needed as a particle beam for medical treatment is a carbon ion, carbon ions are generated by the second ion source 2 and are injected into the pre-accelerator 5 via the low-energy beam transport line 4 and are accelerated to energy of 4 MeV/u. The carbon ions which are accelerated to energy of 4 MeV/u are not injected into the post-accelerator 6 but are emitted from a synchrotron injector system 10 with energy of 4 MeV/u as they are and are injected into the synchrotron 7. In the synchrotron 7, the carbon ions are further accelerated to energy which is needed for medical treatment.

As above mentioned, in a case where ions are carbon ions, it is configured such that the carbon ions are not passed through the post-accelerator 6 but are accelerated by the pre-accelerator 5 so as to increase their energy and are emitted directly from the synchrotron injector system 10. The post-accelerator 6 is configured so as to enable to accelerate only protons, therefore, according to the above-mentioned configuration, in comparison with the configuration of an accelerator by which carbon ions also can be accelerated, the amount of electricity which is needed can be decreased, and the size can be miniaturized. Further, carbon ions do not pass through the post-accelerator 6, therefore contamination which is caused by the situation, that is, carbon ions passing through in the post-accelerator 6 hit an electrode, etc. so as to be lost, can be prevented.

Embodiment 3

Figure 3:
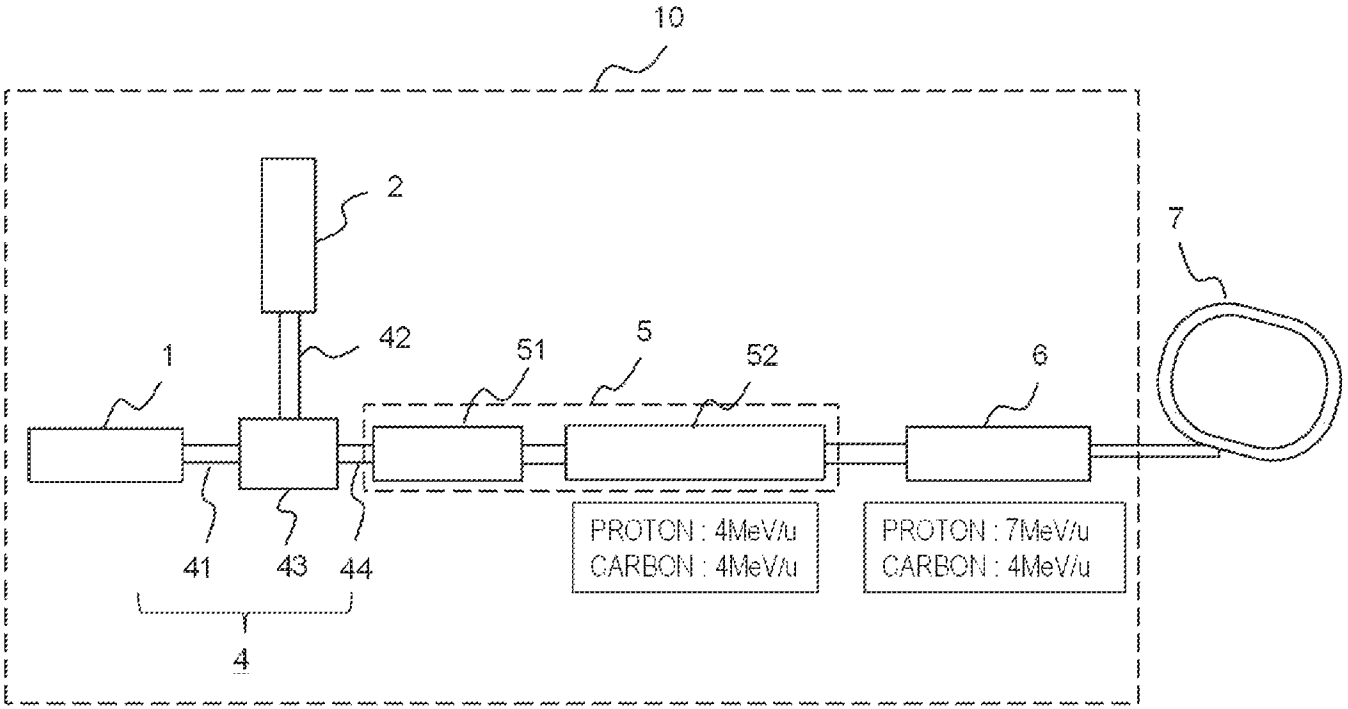
FIG. 3 is a block diagram showing the configuration of a synchrotron injector system according to EMBODIMENT 3 of this invention.

FIG. 3 is a block diagram showing the configuration of a synchrotron injector system according to EMBODIMENT 3 of this invention. In the same way as that of EMBODIMENT 1 and EMBODIMENT 2, a first ion source 1 which generates a proton as a first ion and a second ion source 2 which generates a carbon ion as a second ion having a smaller charge-to-mass ratio than that of the first ion source are provided. A proton which is generated from the first ion source 1 passes through a first low-energy beam transport line 41, a carbon ion which is generated from the second ion source 2 passes through a second low-energy beam transport line 42 and are injected into a joining device 43. A pre-accelerator comprises a front-stage accelerator 51 and a back-stage accelerator 52. It is configured such that the first low-energy beam transport line 41 and the second low-energy beam transport line 42 are joined by the joining device 43 and merge with one beam line 44 so as for a proton or a carbon ion to be injected into the front-stage accelerator 51.

In the front-stage accelerator 51, protons or carbon ions which are injected are bunched. As the front-stage accelerator 51, for example, an accelerator such as RFQ (Radio Frequency Quadrupole) is suitable. Protons or carbon ions which are bunched in the front-stage accelerator 51 are accelerated in the back-stage accelerator 52 as injection energy of a synchrotron 7, for example, to energy of 4 MeV/u which is suitable for carbon ions. As the back-stage accelerator 52, for example, an accelerator such as DTL (Drift Tube Linac) is suitable.

In the same way as that of EMBODIMENT 1, protons or carbon ions which are accelerated by the back-stage accelerator 52 to energy of 4 MeV/u are injected into a post-accelerator 6. The post accelerator 6 is a self-focusing type accelerator which does not contain an electromagnet for converging ions such as APF (Alternating-Phase Focusing)-IH (Interdigital-H) kind linear accelerator, etc. The post-accelerator 6 is configured to accelerate protons, for example, from 4 MeV/u to 7 MeV/u. In a case where ions which are injected into the post-accelerator 6 are protons, for example, the protons are accelerated to energy of 7 MeV/u and are emitted. However, in a case where ions which are injected into the post accelerator 6 are carbon ions, the carbon ions are not accelerated and are emitted with energy of 4 MeV/u as they are. It is configured such that protons with energy of 7 MeV/u or carbon ions with energy of 4 MeV/u are injected into the synchrotron 7 to be accelerated in the synchrotron 7.

As above mentioned, in a synchrotron injector system according to EMBODIMENT 3 of this invention, in a case where an ion which is needed as a particle beam for medical treatment is a proton, for example, protons are generated by the first ion source 1 and are injected into the front-stage accelerator 51 via a low-energy beam transport line 4 so as to be bunched, and are accelerated by the back-stage accelerator 52 to energy of 4 MeV/u. The protons which are accelerated to energy of 4 MeV/u are further accelerated by the post-accelerator 6 to energy of 7 MeV/u so as to be injected into the synchrotron 7. In the synchrotron 7, the protons are further accelerated to energy which is needed for medical treatment.

On the hand, in a case where an ion which is needed as a particle beam for medical treatment is a carbon ion, carbon ions are generated by the second ion source 2 and are injected into the front-stage accelerator 51 via the low-energy beam transport line 4 so as to be bunched and are accelerated to energy of 4 MeV/u. The carbon ions which are accelerated to energy of 4 MeV/u are injected into the post-accelerator 6 but are not accelerated in the post-accelerator 6 and are emitted with energy of 4 MeV/u as they are and are injected into the synchrotron 7. In the synchrotron 7, the carbon ions are further accelerated to energy which is needed for medical treatment.

As above mentioned, in a synchrotron injector system according to EMBODIMENT 3 of this invention, in the same way as that of EMBODIMENT 1, in a case where ions which are injected into the post-accelerator 6 are carbon ions, the carbon ions are not accelerated by the post-accelerator 6 but are passed through the post-accelerator 6 maintaining its energy and are emitted. The post-accelerator 6 is a self-focusing type accelerator which does not contain an electromagnet, therefore, the carbon ions which are injected are not influenced by a magnetic field and can be emitted as they are. The post-accelerator 6 is configured so as to enable to accelerate only protons, therefore, according to the above-mentioned configuration, in comparison with the configuration of an accelerator by which carbon ions also can be accelerated, the amount of electricity which is needed can be decreased, and the size can be miniaturized. Here, in the same way as that which is described in EMBODIMENT 1, it is preferable such that a beam diameter of the post-accelerator 6 is made to be larger than that of the pre-accelerator 5. When a beam diameter of the post-accelerator 6 is made to be larger than a beam diameter of the pre-accelerator 5, contamination in the post-accelerator 6 which is caused by the situation, that is, carbon ions which pass through hit an electrode, etc. and are lost, can be prevented.

Embodiment 4

Figure 4:
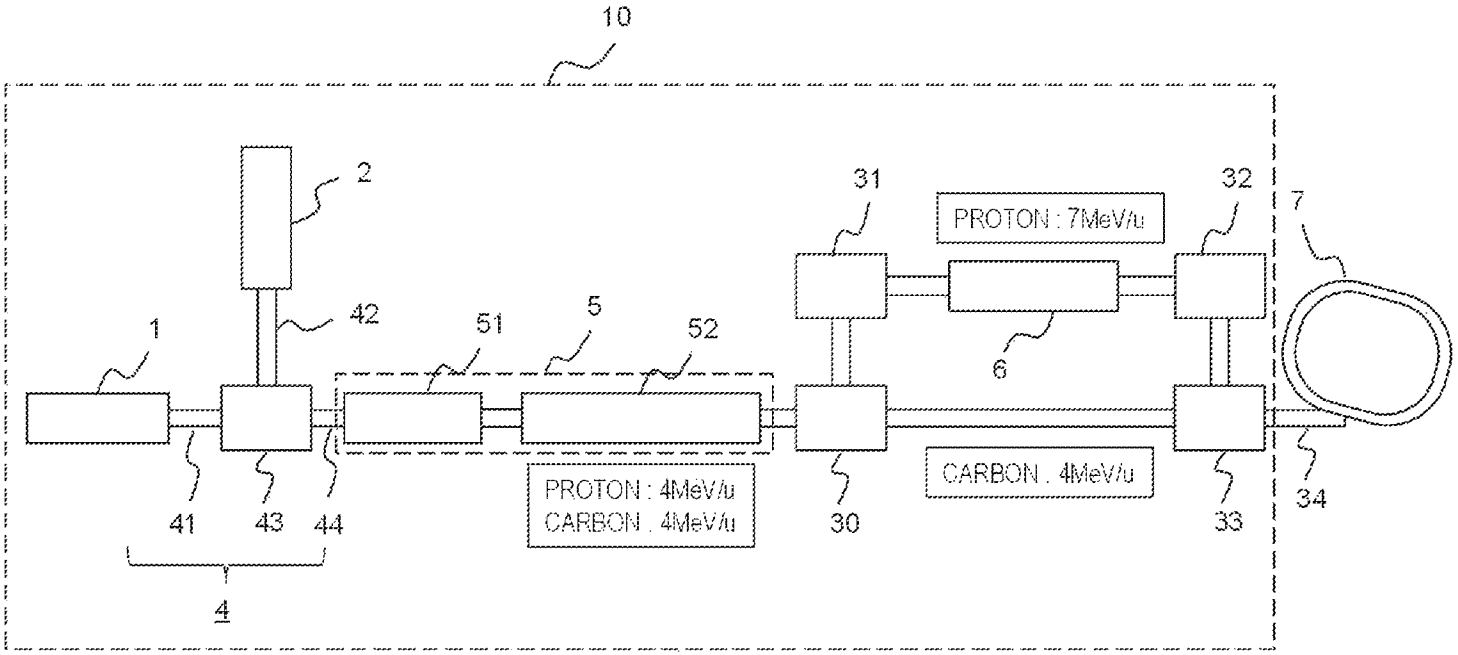
FIG. 4 is a block diagram showing the configuration of a synchrotron injector system according to EMBODIMENT 4 of this invention.

FIG. 4 is a block diagram showing the configuration of a synchrotron injector system according to EMBODIMENT 4 of this invention. In EMBODIMENT 4, in the same way as that of EMBODIMENT 3, protons or carbon ions are bunched in a front-stage accelerator 51, and in a back-stage accelerator 52, protons or carbon ions are accelerated as incident energy to energy of 4 MeV/u, for example, which is suitable to carbon ions.

Protons or carbon ions which are emitted from the back-stage accelerator 52 are injected into a distributor 30 in the same way as that of EMBODIMENT 2. In the distributor 30, in a case where ions which are injected into are protons, the protons are distributed so as to be injected into a post-accelerator 6 via a deflector 31. It is configured such that the protons which are injected into the post-accelerator 6 are accelerated by the post-accelerator 6 to energy of 7 MeV/u, for example, pass through a joining device 33 via a deflector 32 and merge with a medium energy beam transport line 34 and are emitted from a synchrotron injector system 10. On the hand, it is configured such that in a case where ions which are injected into the distributor 30 are carbon ions, the carbon ions are not injected into the post-accelerator 6 and are emitted from the medium energy beam transport line 34 maintaining its energy as they are.

As above mentioned, in a case of carbon ions, it is configured such that the carbon ions are not passed through the post-accelerator 6 but the carbon ions which are accelerated by the back-stage accelerator 52 so as to increase their energy are emitted directly form the synchrotron injector system 10. The post-accelerator 6 is configured so as to enable to accelerate only protons, therefore, according to the above-mentioned configuration, in comparison with the configuration of an accelerator by which carbon ions also can be accelerated, the amount of electricity which is needed can be decreased, and the size can be miniaturized. In a synchrotron injector system according to EMBODIMENT 4, in the same way as that of EMBODIMENT 2, the carbon ions do not pass through the post-accelerator 6, therefore contamination in the post-accelerator 6 which is caused by the situation, that is, carbon ions which pass through hit an electrode, etc. and are lost, can be prevented.

DESCRIPTION OF REFERENCE SIGNS

1. first ion source
2. second ion source
4. low-energy beam transport line
5. pre-accelerator
6. post-accelerator
7. synchrotron

10. synchrotron injector system
30. distributor
34. medium energy beam transport line
43. joining device

The invention claimed is:

1. A synchrotron injector system, which emits an ion which is injected into a synchrotron, comprising a first ion source which generates a first ion, a second ion source which generates a second ion having a smaller charge-to-mass ratio than a charge-to-mass ratio of the first ion, a pre-accelerator having the capability to enable to accelerate both the first ion and the second ion, a low-energy beam transport line which is constituted in such a way to inject either the first ion or the second ion into the pre-accelerator, and a post-accelerator of a self-focusing type which accelerates only the first ion after acceleration which is emitted from the pre-accelerator.

2. The synchrotron injector system according to claim 1, wherein the post-accelerator is constituted in such a way for both the first ion and the second ion to be injected and in a case where the first ion is injected, an acceleration operation is performed and in a case where the second ion is injected, an acceleration operation is not performed.

3. The synchrotron injector system according to claim 2, wherein a beam diameter of the post-accelerator is larger than a beam diameter of the pre-accelerator.

4. The synchrotron injector system according to claim 1, further comprising a distributor, wherein in a case where an ion which is emitted from the pre-accelerator is the first ion, the first ion is injected into the post-accelerator and in a case where an ion which is emitted from the pre-accelerator is the second ion, the second ion is not injected into the post-accelerator but is emitted from the synchrotron injector system by the distributor.

5. The synchrotron injector system according to claim 1, wherein the pre-accelerator comprises a front-stage accelerator which bunches ions which are injected and a back-stage accelerator which accelerates ions which are injected by the front-stage accelerator.

6. The synchrotron injector system according to claim 1, wherein the first ion is a proton and the second ion is a carbon ion.

7. An operation method of a synchrotron injector system, which injects an ion into a synchrotron, comprising a first ion source which generates a first ion, a second ion source which generates a second ion having a smaller charge-to-mass ratio than a charge-to-mass ratio of the first ion, a pre-accelerator having the capability to enable to accelerate both the first ion and the second ion, a low-energy beam transport line which is constituted in such a way to inject either the first ion or the second ion into the pre-accelerator, and a post-accelerator of a self-focusing type which accelerates an ion after acceleration which is emitted from the pre-accelerator, wherein in a case where an ion which is injected into the post-accelerator is the first ion, an acceleration operation is performed and in a case where an ion which is injected into the post accelerator is the second ion, an acceleration operation is not performed.

8. The operation method of a synchrotron injector system according to claim 7, wherein the first ion is a proton and the second ion is a carbon ion.

* * * * *